US012037861B2

(12) United States Patent
Malki et al.

(10) Patent No.: US 12,037,861 B2
(45) Date of Patent: Jul. 16, 2024

(54) WELLBORE CASING WHILE DRILLING WITH DRILLING JAR

(71) Applicant: Saudi Arabian Oil Company, Dhahran (SA)

(72) Inventors: Bandar S. Malki, Alshulah (SA); Vitalii Chereshniuk, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/049,091

(22) Filed: Oct. 24, 2022

(65) Prior Publication Data

US 2024/0133259 A1 Apr. 25, 2024

(51) Int. Cl.
*E21B 31/113* (2006.01)
*E21B 31/00* (2006.01)
*E21B 33/14* (2006.01)

(52) U.S. Cl.
CPC ..... *E21B 31/113* (2013.01); *E21B 31/002* (2013.01); *E21B 33/14* (2013.01)

(58) Field of Classification Search
CPC ..... E21B 33/14; E21B 31/107; E21B 31/113; E21B 31/002; E21B 7/20
See application file for complete search history.

(56) References Cited

U.S. PATENT DOCUMENTS 2,961,048 A 11/1960 Davis
3,057,418 A * 10/1962 Koppl ..... E21B 31/107 285/376
7,299,885 B2 11/2007 Baird
9,062,507 B2 6/2015 Knobloch, Jr. et al.
10,577,874 B2 * 3/2020 Poe ..... E21B 17/06
2009/0288821 A1 * 11/2009 Eriksen ..... E21B 21/106 166/250.01
2013/0299169 A1 * 11/2013 Rex ..... E21B 43/108 166/285
2015/0337640 A1 * 11/2015 Huang ..... G06F 30/20 703/10
2016/0326807 A1 * 11/2016 Jerez ..... E21B 7/28
2019/0048675 A1 2/2019 Alley et al.
2023/0043864 A1 * 2/2023 Gao ..... E21B 33/16

OTHER PUBLICATIONS

"Jar" Schlumberger Energy Glossary, retrieved on Sep. 4, 2022, retrieved from URL <https://glossary.slb.com/Terms/j/jar.aspx>, 3 pages.

* cited by examiner

*Primary Examiner* — Shane Bomar
(74) *Attorney, Agent, or Firm* — Fish & Richardson P.C.

(57) ABSTRACT

A well tool assembly includes a first well tool and a second well tool. The first well tool includes a first casing, a first drill bit and a drilling jar. The first drill bit is configured to drill through a subterranean zone to form a wellbore. The drilling jar is axially coupled to the casing uphole of the first drill bit. The drilling jar has an outer diameter that is greater than an outer diameter of the first casing. The second well tool has a second casing and a second drill bit. The second casing has an outer diameter that is smaller than an inner diameter of the drilling jar. The second drill bit has an outer diameter that is smaller than the inner diameter of the drilling jar.

14 Claims, 3 Drawing Sheets

WELLBORE CASING WHILE DRILLING WITH DRILLING JAR

TECHNICAL FIELD

This disclosure relates to forming and completing wellbores.

BACKGROUND

Hydrocarbons entrapped in subsurface reservoirs can be produced to the surface of the Earth by forming wellbores from the surface through a subterranean zone (i.e., a formation, multiple formations, a portion of a formation) to the subsurface reservoirs. A wellbore drilling assembly is used to form the wellbore in the subterranean zone. As the wellbore is formed in the subterranean zone, wellbore tubing (called casing) is lowered into the wellbore for subsequent completion. Sometimes, the casing can get stuck within the wellbore. Certain well tools (called jars) are used to unstick or release a stuck casing from within the wellbore.

SUMMARY

This specification describes technologies relating to wellbore casing while drilling (CWD) with drilling jar.

Certain aspects of the subject matter described here can be implemented as a method. A wellbore is formed through a subterranean zone from a surface of the Earth using a first well tool, which includes a first casing, a drilling jar and a first drill bit. The drilling jar is axially coupled to the first casing and includes an outer diameter that is greater than an outer diameter of the first casing. The first drill bit is configured to drill through the subterranean zone to form the wellbore. In response to determining that the first casing is stuck within the subterranean zone, the drilling jar is activated to release the first casing. After the first casing is released, wellbore formation continues using the first well tool. While retaining the first well tool within the wellbore, the wellbore is cemented by flowing cement in an annular region formed between an inner wall of the wellbore and an outer surface of the well tool. After cementing the wellbore, a second well tool is lowered through the first well tool. The second well tool includes a second casing having an outer diameter that is smaller than an inner diameter of the first casing. The second well tool includes a second drill bit configured to drill through the subterranean zone. The second drill bit has an outer diameter that is smaller than an inner diameter of the drilling jar.

An aspect combinable with any other aspect includes the following features. Wellbore formation continues using the second well tool lowered through the first well tool.

An aspect combinable with any other aspect includes the following features. Wellbore formation using the second well tool continues by drilling out the first drill bit using the second drill bit.

An aspect combinable with any other aspect includes the following features. The drilling jar is hydraulically or mechanically activated.

An aspect combinable with any other aspect includes the following features. The wellbore is cemented without removing the drilling jar from within the wellbore.

An aspect combinable with any other aspect includes the following features.

Certain aspects of the subject matter described here can be implemented as a method. While forming a wellbore through a subterranean zone from a surface of the Earth using a first well tool, it is determined that a first casing in the first well tool is stuck within the subterranean zone. The first well tool includes the first casing, a drilling jar and a first drill bit. The drilling jar is axially coupled to the first casing and includes an outer diameter that is greater than an outer diameter of the first casing. The first drill bit is configured to drill through the subterranean zone to form the wellbore. In response, the drilling jar is activated to release the first casing. After the first casing is released, while retaining the first well tool within the wellbore, the wellbore is cemented by flowing cement in an annular region between an inner wall of the wellbore and an outer surface of the first well tool. After cementing the wellbore, the wellbore forming operation continues using a second well tool lowered into the wellbore through the first well tool. The second well tool includes a second casing having an outer diameter that is smaller than an inner diameter of the first casing. The second well tool includes a second drill bit configured to drill through the subterranean zone. The second drill bit has an outer diameter that is smaller than inner diameter of the drilling jar.

An aspect combinable with any other aspect includes the following features. After the wellbore is formed to a determined depth using the second well tool, the second well tool is cemented within the wellbore.

An aspect combinable with any other aspect includes the following features. To continue forming the wellbore using the second well tool, the first drill bit is drilled out using the second drill bit.

An aspect combinable with any other aspect includes the following features. The drilling jar is hydraulically or mechanically activated.

An aspect combinable with any other aspect includes the following features. While the first well tool is cemented without removing the drilling jar from within the wellbore.

Certain aspects of the subject matter described here can be implemented as a well tool assembly. The assembly includes a first well tool and a second well tool. The first well tool includes a first casing, a first drill bit and a drilling jar. The first drill bit is configured to drill through a subterranean zone to form a wellbore. The drilling jar is axially coupled to the casing uphole of the first drill bit. The drilling jar has an outer diameter that is greater than an outer diameter of the first casing. The second well tool has a second casing and a second drill bit. The second casing has an outer diameter that is smaller than an inner diameter of the drilling jar. The second drill bit has an outer diameter that is smaller than the inner diameter of the drilling jar.

An aspect combinable with any other aspect includes the following features. The second well tool is configured to be lowered into the wellbore through the first well tool.

An aspect combinable with any other aspect includes the following features. The second drill bit is configured to drill out the first drill bit in response to the second well tool being lowered into the wellbore through the first well tool.

An aspect combinable with any other aspect includes the following features. The drilling jar is configured to be activated hydraulically or mechanically to release a stuck first casing within the wellbore.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes a well tool assembly and techniques of using the well tool assembly to free stuck casing while drilling a wellbore through a subterranean zone. In particular, implementing the techniques described here allows using a jar (sometimes called a drilling jar) to be used to free stuck casing, followed by using the wellbore drilling assembly to continue forming the wellbore, while retaining the job within the wellbore being formed. In other words, after the jar has been activated to free the stuck casing, the job need not be retrieved from within the wellbore. Instead, wellbore formation can continue with the job in the wellbore.

Figure 1A:
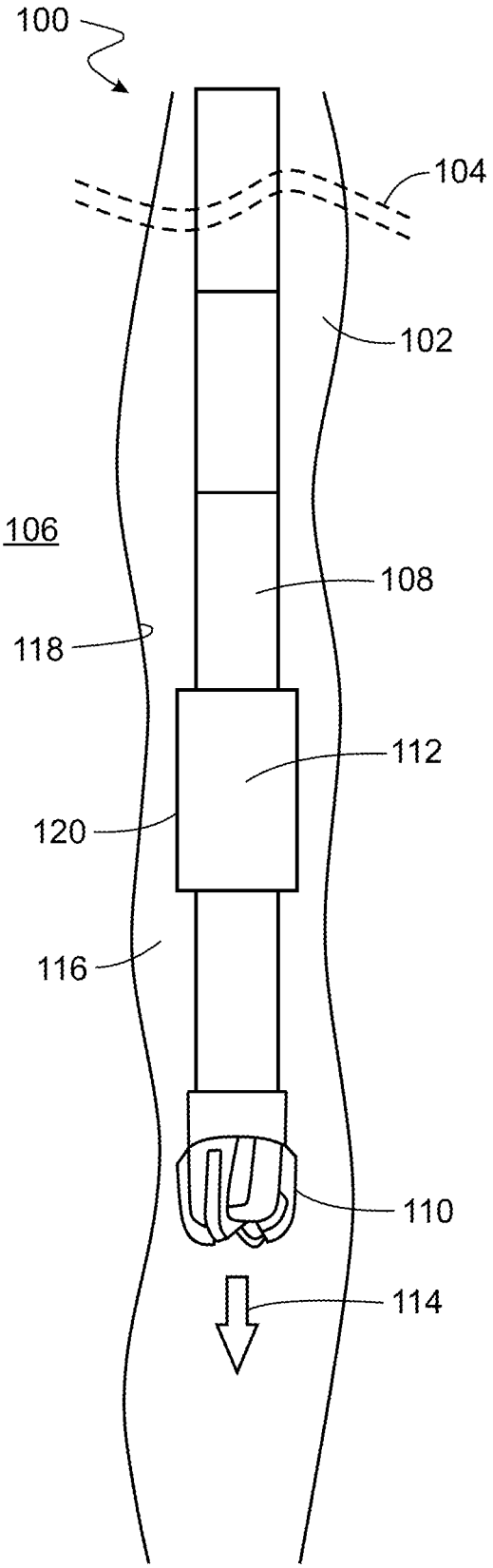
FIGS. 1A-1D are schematic diagrams of casing while drilling with the drilling jar.

FIGS. 1A-1D are schematic diagrams of casing while drilling with the drilling jar. FIG. 1A is a schematic diagram showing a well tool assembly 100 being used to form a wellbore 102 from a surface 104 of the Earth through a subterranean zone 1062 words a subsurface reservoir (not shown). The well tool assembly 100 includes a first well tool having a first casing 108. A first drill bit 110, which is configured to drill through the subterranean zone 1062 form the wellbore 102, is coupled to an end (the downhole end) of the casing 108. The drilling jar 112 (sometimes called ajar) is actually coupled to the casing 108 uphole of the first drill bit 110. In some implementations, the casing 108 can be deployed as two pieces of wellbore tubulars; one connected to an uphole end the drilling jar 112 and extending in an uphole direction towards the surface 104, and another connected to a downhole end of the drilling jar 112 and extending in a downhole direction into the wellbore 102 to be connected to the first drill bit 110.

The first well tool is dimensioned to be able to run into the wellbore 102. That is, an outer diameter of the first well tool is less than an inner diameter of the wellbore 102, which allows the first well tool to be lowered into the wellbore 102. In some implementations, an outer diameter of the drilling jar 112 is larger than an outer diameter of the casing 108. Such construction of the drilling jar 112 allows an inner diameter of the drilling jar 112 to be maximized so as to allow the passage of a second well tool (described later).

In operation, a drilling rig (not shown) is installed at the surface 104 to the well tool that includes the first casing 108, the first drill bit 110 and the drilling jar 112 into the wellbore 102 as the first drill bit 110 is through the subterranean zone 106. As the first casing 108 is lowered into the wellbore 102, the casing 108 may get stuck in the wellbore 102. For example, the casing 108 can contact the subterranean zone and become stuck such that the casing 108 can neither be lowered downhole or raised uphole. Casing can stuck for a few reasons: for example, differential sticking due to difference between hydrostatic pressure in wellbore and wellbore pore pressure whenever casing is across permeable formation; mechanical sticking due to wellbore instability because hole is packed-off because of formation break-outs or sloughing shale; mechanical sticking due to under gauged hole (swelling shale, key seats, etc.). In such situations, the drilling jar 112 is activated to release or unstick the casing 108 in the wellbore 102. For example, the drilling jar 112 can be mechanically or hydraulically activated. There are two main types of Jar: Mechanical Jar (single and double action), Hydraulic Jar (double action or double action with mechanism latch). Type of Jar can be chosen based on the most possible type of stuck, possibility to deliver required weight to activate Jar. Mechanical Jars, for example, have preset load that causes the jar to trip. Once that load is exceeded, a hammer strikes an anvil causing casing string to shake with high impact upward or downward at direction opposite the direction in which the casing is stuck. After the casing 108 has been released by operation of the drilling jar 112, the operation of forming the wellbore 102 using the first well tool is continued. By doing so, the first well tool, i.e., the combination of the casing 108, the drill bit 110 and the drilling jar 112, continue to move in a downhole direction shown by the arrow 114.

In certain well operations that implement a drilling jar to unstick or release a casing, the drilling jar needs to be removed from within the wellbore before further wellbore formation operations can be performed. The reason for doing so is because subsequent wellbore formation operations involve lowering tools through the casing, and such operations are rendered difficult or impossible because of the small inner diameter of the drilling jar. In contrast, in the implementations described in this disclosure, an inner diameter of the drilling jar 112 is larger than an inner diameter of a conventional drilling jar. To accommodate the increased inner diameter, an outer diameter of the drilling jar 112 is correspondingly increased and is greater than an outer diameter of the casing 108. By using the modified drilling jar 112 described in this disclosure, the operation of forming the wellbore 102 can be continued while retaining the drilling jar 112 within the wellbore 102, i.e., without needing to trip out the drilling jar 112 before continuing the wellbore formation operations.

Figure 1B:
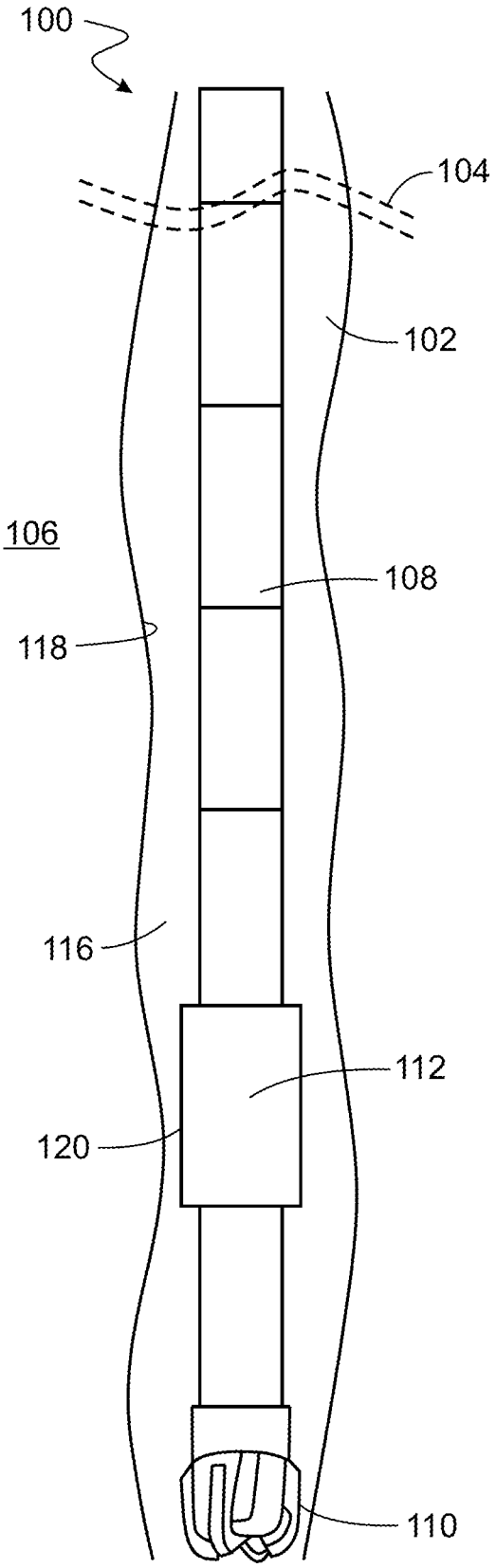
Figure 1C:
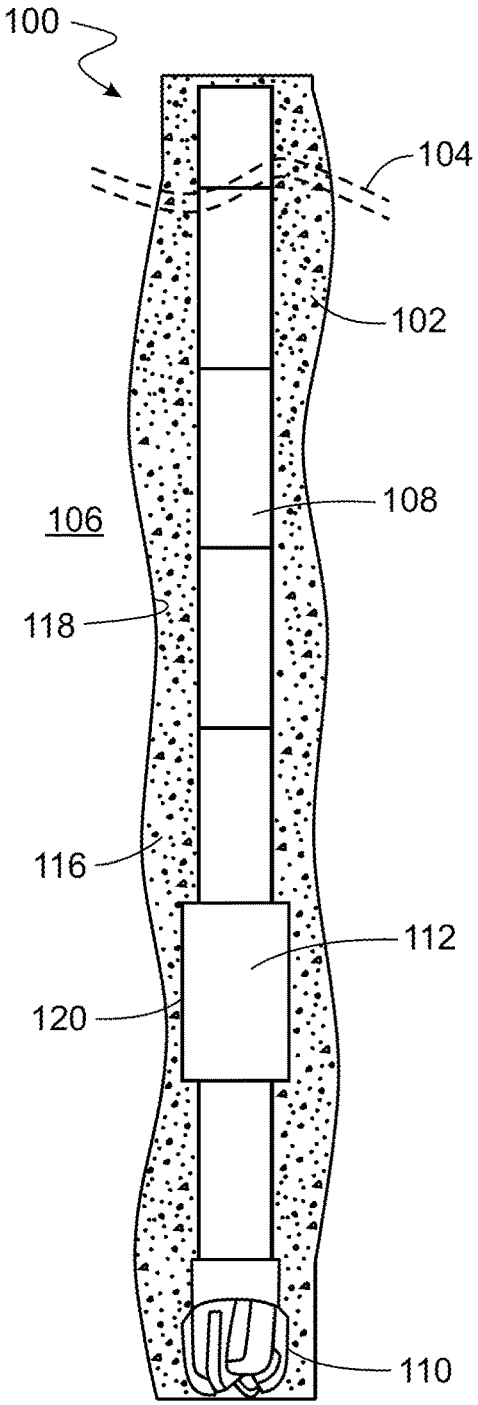

FIG. 1B is a schematic diagram showing that the drill bit 110 has reached a pre-determined depth within the wellbore 102. For example, the length of the casing 108 used to form the first well tool could have been selected based on the pre-determined depth or based on operational constraints (e.g., the length of the casing that the drilling rig can accommodate). Once the drill bit 110 has reached the pre-determined depth within the wellbore 102, the first well tool is cemented within the wellbore 102. To do so, cement is flowed from the surface 104 through the first well tool, i.e., through the inner diameter of the casing 108, through the inner diameter of the drilling jar 112, through the drill bit 110, and the through the annulus 116 formed between an inner wall 118 of the wellbore 102 and an outer surface 120 of the first well tool. The drilling jar 112 is cemented in place within the wellbore 102 together with the casing 108 and the drill bit 110. FIG. 1C is a schematic diagram showing the first well tool cemented within the wellbore 102.

Figure 1D:
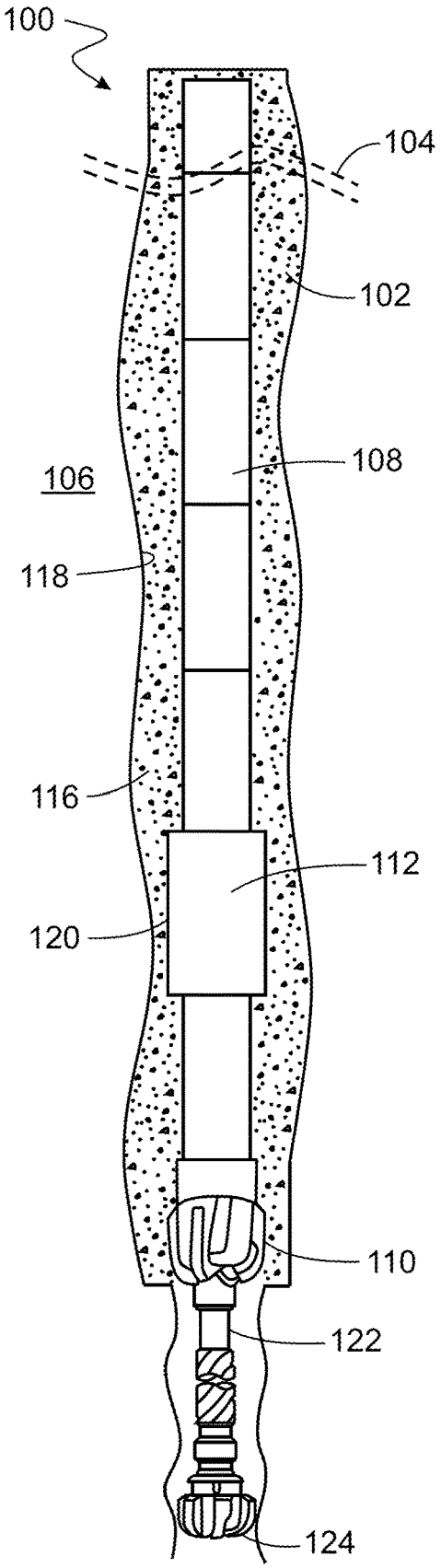

After the first well tool has been cemented within the wellbore 102, a second well tool is lowered into the wellbore 102 through the first well tool to continue forming the wellbore. FIG. 1D is a schematic diagram showing the second well tool lowered into the wellbore 102 through the first well tool. The second well tool as a casing 122 that is substantially similar to the casing 108 except that an outer diameter of the casing 122 smaller than an inner diameter of the casing 108. The second well tool also includes a drill bit 124 that is configured to drill both through the subterranean zone 102 and through the drill bit 110. The drill bit 124 has an outer diameter that is smaller than an inner diameter of the drill bit 110. The operation of forming the wellbore 102 further downhole through the subterranean zone 106 can be continued by operating the second well tool in a manner similar to the first well tool. In some implementations, the second well tool can include a drilling jar (not shown)

similar to the drilling jar 112 to release or unstick the casing 122 should the casing 120 to get stuck within the wellbore 102. In this manner, multiple well tools can be successively deployed to form the wellbore to the desire downhole location, e.g., the location of the subsurface reservoir.

Figure 2:
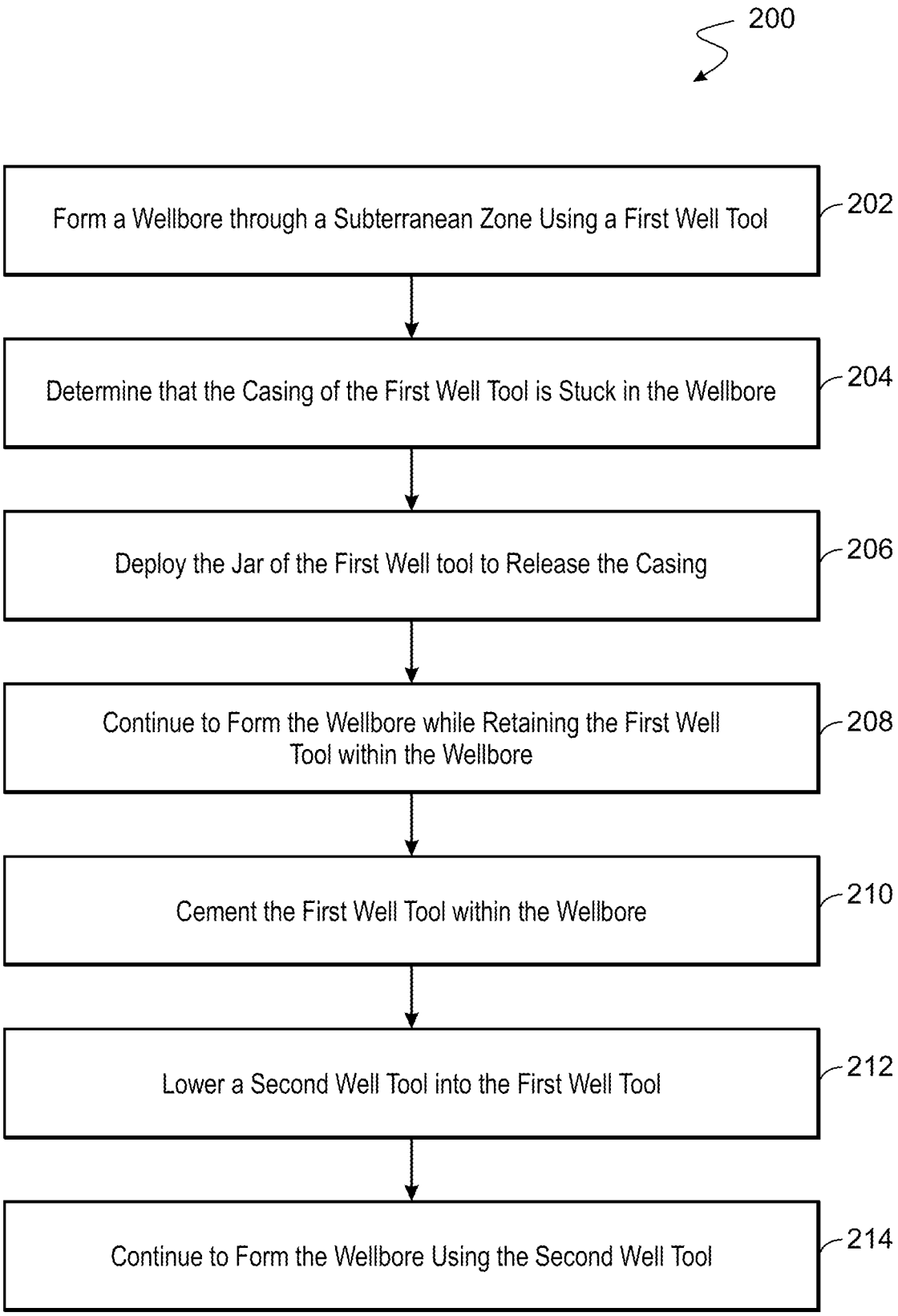
FIG. 2 is a flowchart of an example of a process of casing while drilling with the drilling jar.

FIG. 2 is a flowchart of an example of a process 200 of casing while drilling with the drilling jar. In some implementations, some or all of the process 200 can be implemented using a wellbore drilling assembly that includes a well tool assembly such as the one described with reference to FIGS. 1A-1D. At 202, a wellbore is formed through a subterranean zone from a surface of the Earth using a first well tool, e.g., the first well tool described with reference to FIGS. 1A-1D. At 204, it is determined that the casing of the first well tool is stuck in the wellbore. In response to determining that the casing is stuck within the wellbore (i.e., stuck to the subterranean zone), at 206, the drilling jar is deployed, i.e., activated, to release the casing. By activating the drilling jar, e.g., mechanically or hydraulically, the casing is released or unstuck from the subterranean zone. At 210, after the casing is released, the operations to form the wellbore using the well tool are continued. At 210, while retaining the well tool including the drilling jar within the wellbore, the wellbore is cemented by flowing cement in an annular region formed between an inner wall of the wellbore and an outer surface of the well tool wellbore. At 212, after cementing the wellbore, a second well tool is lowered through the first well tool. At 214, the operations to form the wellbore are continued using the second well tool. To do so, the drill bit in the second well tool drills through the drill bit in the first one to.

Thus, particular implementations of the subject matter have been described. Other implementations are within the scope of the following claims.

The invention claimed is:

1. A method comprising:

forming a wellbore through a subterranean zone from a surface of the Earth using a first well tool comprising:
- a first casing,
- a drilling jar axially coupled to the first casing, the drilling jar comprising an outer diameter that is greater than an outer diameter of the first casing, and
- a first drill bit configured to drill through the subterranean zone to form the wellbore;

in response to determining that the first casing is stuck within the subterranean zone, activating the drilling jar to release the first casing;

after the first casing is released, continuing to form the wellbore using the first well tool;

while retaining the first well tool within the wellbore, cementing the wellbore by flowing cement in an annular region formed between an inner wall of the wellbore and an outer surface of the well tool; and after cementing the wellbore, lowering a second well tool through the first well tool, the second well tool comprising:
- a second casing having an outer diameter that is smaller than an inner diameter of the first casing; and
- a second drill bit configured to drill through the subterranean zone, the second drill bit having an outer diameter that is smaller than an inner diameter of the drilling jar.

2. The method of claim 1, further comprising continuing to form the wellbore using the second well tool lowered through the first well tool.

3. The method of claim 2, wherein continuing to form the wellbore using the second well tool comprises drilling out the first drill bit using the second drill bit.

4. The method of claim 1, wherein activating the drilling jar to release the first casing comprises hydraulically or mechanically activating the drilling jar.

5. The method of claim 1, wherein, while retaining the first well tool within the wellbore, cementing the wellbore by flowing cement in the annular region formed between the inner wall of the wellbore and the outer surface of the well tool comprises cementing the wellbore without removing the drilling jar from within the wellbore.

6. A method comprising:

while forming a wellbore through a subterranean zone from a surface of the Earth using a first well tool comprising:
- a first casing,
- a drilling jar axially coupled to the first casing, the drilling jar comprising an outer diameter that is greater than an outer diameter of the first casing, and
- a first drill bit configured to drill through the subterranean zone to form the wellbore, determining that the first casing is stuck within the subterranean zone;

in response to determining that the first casing is stuck within the subterranean zone, activating the drilling jar to release the first casing;

after the first casing is released, while retaining the first well tool within the wellbore, cementing the wellbore by flowing cement in an annular region formed between an inner wall of the wellbore and an outer surface of the first well tool; and after cementing the wellbore, continuing to form the wellbore using a second well tool lowered into the wellbore through the first well tool, the second well tool comprising:
- a second casing having an outer diameter that is smaller than an inner diameter of the first casing; and
- a second drill bit configured to drill through the subterranean zone, the second drill bit having an outer diameter that is smaller than an inner diameter of the drilling jar.

7. The method of claim 6, further comprising, after the wellbore is formed to a determined depth using the second well tool, cementing the second well tool within the wellbore.

8. The method of claim 6, wherein continuing to form the wellbore using the second well tool comprises drilling out the first drill bit using the second drill bit.

9. The method of claim 6, wherein activating the drilling jar to release the first casing comprises hydraulically or mechanically activating the drilling jar.

10. The method of claim 6, wherein, while retaining the first well tool within the wellbore, cementing the wellbore by flowing cement in the annular region formed between the inner wall of the wellbore and the outer surface of the first well tool comprises cementing the wellbore without removing the drilling jar from within the wellbore.

11. A well tool assembly comprising:

a first well tool comprising:
- a first casing,
- a first drill bit configured to drill through a subterranean zone to form a wellbore,
- a drilling jar axially coupled to the casing uphole of the first drill bit, the drilling jar comprising an outer diameter that is greater than an outer diameter of the first casing; and a second well tool comprising:

a second casing having an outer diameter that is smaller than an inner diameter of the drilling jar; and a second drill bit having an outer diameter that is smaller than the inner diameter of the drilling jar.

12. The assembly of claim 11, wherein the second well tool is configured to be lowered into the wellbore through the first well tool.

13. The assembly of claim 12, wherein the second drill bit is configured to drill out the first drill bit in response to the second well tool being lowered into the wellbore through the first well tool.

14. The assembly of claim 11, wherein the drilling jar is configured to be activated hydraulically or mechanically to release a stuck first casing within the wellbore.

* * * * *